US008261507B2

(12) United States Patent
Hahn et al.

(10) Patent No.: US 8,261,507 B2
(45) Date of Patent: Sep. 11, 2012

(54) FLOORING PROFILE

(75) Inventors: Kris Hahn, Roswell, GA (US); Jean Briere, Ooltewah, TN (US); Larry Pryor, Chattanooga, TN (US)

(73) Assignee: Columbia Insurance Company, Omaha, NE (US)

( * ) Notice: Subject to any disclaimer, the term of this patent is extended or adjusted under 35 U.S.C. 154(b) by 869 days.

(21) Appl. No.: 11/432,922

(22) Filed: May 12, 2006

(65) Prior Publication Data

US 2007/0261350 A1 Nov. 15, 2007

(51) Int. Cl.
*E04B 5/00* (2006.01)

(52) U.S. Cl. ..... 52/592.1; 52/589.1; 52/582.1; 52/747.1

(58) Field of Classification Search ..... 52/592.1, 52/592.2, 592.4, 589.1, 591.3, 391, 591.5, 52/745.19, 745.2, 747.1, 582.1
See application file for complete search history.

(56) References Cited

U.S. PATENT DOCUMENTS

| | | | | | |
|---|---|---|---|---|---|
| 316,175 | A | * | 4/1885 | Putney | 52/592.1 |
| 337,564 | A | * | 3/1886 | Daugherty | 52/592.1 |
| 1,124,228 | A | | 1/1915 | Houston | 403/381 |
| 1,430,996 | A | | 10/1922 | Horlin | |
| 1,472,521 | A | * | 10/1923 | Harrison | 428/318.6 |
| 1,764,331 | A | | 6/1930 | Moratz | 52/364 |
| 1,778,068 | A | | 10/1930 | Fetz | |
| 1,778,069 | A | | 10/1930 | Fetz | |
| 1,778,352 | A | | 10/1930 | Bruce | |
| 1,832,397 | A | | 11/1931 | Hultquist | |
| 1,859,667 | A | | 5/1932 | Gruner | 52/578 |
| 1,925,068 | A | | 8/1933 | Gray | 20/8 |
| 1,936,028 | A | * | 11/1933 | Rockwell | 52/364 |
| 1,986,739 | A | | 1/1935 | Mitte | 72/19 |
| 2,004,917 | A | | 6/1935 | Johnson | 20/8 |
| 2,017,185 | A | * | 10/1935 | Rockwell | 52/364 |
| 2,031,596 | A | | 2/1936 | Fulbright | 20/8 |
| 2,045,068 | A | | 6/1936 | Bruce | 20/8 |
| 2,092,694 | A | * | 9/1937 | Crooks | 52/366 |
| 2,114,451 | A | | 4/1938 | Mattes | 72/23 |
| 2,152,694 | A | * | 4/1939 | Hoover | 52/364 |
| 2,226,540 | A | | 12/1940 | Boettcher | |
| 2,227,878 | A | | 1/1941 | Crooks | 20/8 |
| 2,269,926 | A | | 1/1942 | Crooks | 20/7 |

(Continued)

FOREIGN PATENT DOCUMENTS

WO WO 94/06606 3/1994

(Continued)

OTHER PUBLICATIONS

U.S. Appl. No. 11/395,035, filed Mar. 31, 2006, Hahn, Non-Final Office Action Mailed Jul. 18, 2008.

(Continued)

*Primary Examiner* — Robert Canfield
*Assistant Examiner* — Jessie Fonseca
(74) *Attorney, Agent, or Firm* — Ballard Spahr LLP

(57) ABSTRACT

The invention relates to a flooring panel having opposed pairs of substantially parallel side edges, a tongue connector member, and a groove connector member. In one aspect, the tongue connector member extends along one side edge and the groove connector member extends along the opposed side edge. The tongue connector member and the groove connector member are configured to cooperatively couple with each other such that portions of the coupled flooring panels are positioned in abutting relationship.

50 Claims, 2 Drawing Sheets

U.S. PATENT DOCUMENTS

| | | | | |
|---|---|---|---|---|
| 2,269,927 | A | 1/1942 | Crooks | 20/7 |
| 2,328,051 | A * | 8/1943 | Bull | 52/489.2 |
| 2,817,125 | A | 12/1957 | Johns | 20/8 |
| 2,874,603 | A | 2/1959 | Boettcher | 85/28 |
| 3,200,553 | A | 8/1965 | Frashour et al. | 52/595 |
| 3,551,270 | A | 12/1970 | Sharkey | 161/113 |
| 3,567,563 | A | 3/1971 | Haudenchild et al. | 161/37 |
| 3,577,694 | A | 5/1971 | Omholt | 52/483 |
| 3,579,941 | A | 5/1971 | Tibbals | 52/384 |
| 3,596,422 | A | 8/1971 | Boettcher | 52/368 |
| 3,619,963 | A | 11/1971 | Omholt | 52/483 |
| 3,740,910 | A | 6/1973 | Taylor et al. | 52/315 |
| 174,261 | A | 2/1976 | Kuhn | |
| 4,100,710 | A | 7/1978 | Kowallik | 52/309.9 |
| 4,489,512 | A | 12/1984 | Schovee | 40/154 |
| 4,599,842 | A | 7/1986 | Counihan | 52/586 |
| 4,782,989 | A | 11/1988 | Wallin et al. | 227/149 |
| 4,831,806 | A | 5/1989 | Niese et al. | 52/391 |
| 4,856,250 | A | 8/1989 | Gronau et al. | 52/480 |
| 4,890,434 | A | 1/1990 | Niese | 52/393 |
| 5,016,413 | A | 5/1991 | Counihan | 52/391 |
| 5,088,260 | A | 2/1992 | Barton et al. | 52/416 |
| 5,465,548 | A | 11/1995 | Niese | 52/741.1 |
| 5,500,980 | A | 3/1996 | Morrow et al. | 16/16 |
| 5,570,554 | A | 11/1996 | Searer | 52/539 |
| 5,609,000 | A | 3/1997 | Niese | 52/480 |
| 5,706,621 | A | 1/1998 | Pervan | 52/403.1 |
| 5,879,781 | A | 3/1999 | Mehta et al. | 428/137 |
| 5,894,700 | A | 4/1999 | Sweet | 52/391 |
| 6,182,413 | B1 | 2/2001 | Magnusson | 52/589.1 |
| RE37,615 | E | 4/2002 | Niese | 52/480 |
| 6,484,467 | B2 | 11/2002 | Crout | 52/483.1 |
| 6,610,228 | B2 | 8/2003 | Capps | 264/109 |
| 6,637,169 | B2 | 10/2003 | Niese et al. | 52/480 |
| 6,682,254 | B1 | 1/2004 | Olofsson et al. | 403/375 |
| 6,715,253 | B2 | 4/2004 | Pervan | 52/578 |
| 6,752,565 | B2 | 6/2004 | Schrage | |
| 6,851,241 | B2 | 2/2005 | Pervan | 52/592.1 |
| 6,918,221 | B2 | 7/2005 | Williams | 52/592.1 |
| 6,968,664 | B2 | 11/2005 | Thiers et al. | 52/592.1 |
| 890,436 | A1 | 6/2008 | Momberg | |
| 2002/0144479 | A1 | 10/2002 | Chun et al. | 52/478 |
| 2003/0115829 | A1 | 6/2003 | Southern et al. | 52/746.1 |
| 2003/0121226 | A1 | 7/2003 | Bolduc | 52/391 |
| 2003/0208980 | A1 | 11/2003 | Miller et al. | 52/592.1 |
| 2004/0040242 | A1 | 3/2004 | Randjelovic | 52/403.1 |
| 2004/0098926 | A1 | 5/2004 | Haytayan | 52/40 |
| 2004/0098927 | A1 | 5/2004 | Haytayan | 52/40 |
| 2004/0107665 | A1 | 6/2004 | Faxe et al. | 52/578 |
| 2004/0141804 | A1 | 7/2004 | Olofsson et al. | 403/267 |
| 2004/0182034 | A1 | 9/2004 | Eberle, III | 52/586.1 |
| 2005/0005558 | A1 | 1/2005 | Bolduc | 52/582.1 |
| 2005/0039413 | A1 | 2/2005 | Schrotenboer | 52/582.1 |
| 2005/0144878 | A1 * | 7/2005 | Grafenauer | 52/578 |
| 2005/0221904 | A1 | 10/2005 | Ford et al. | 473/115 |
| 2005/0252143 | A1 | 11/2005 | Tataei | 52/582.1 |
| 2005/0268571 | A1 | 12/2005 | Magnusson | 52/590.2 |
| 2006/0010818 | A1 | 1/2006 | Knauseder | 52/581 |

FOREIGN PATENT DOCUMENTS

| | | |
|---|---|---|
| WO | WO 03/048482 | 6/2003 |
| WO | WO 03/078750 | 9/2003 |
| WO | WO 2005/098164 | 10/2005 |
| WO | WO 2005/103411 | 11/2005 |

OTHER PUBLICATIONS

U.S. Appl. No. 11/395,035, filed Mar. 31, 2006, Hahn, Response to Non-Final Office Action Mailed Jul. 18, 2008, Dec. 28, 2008.

U.S. Appl. No. 11/395,035, filed Mar. 31, 2006, Hahn, Final Office Action Mailed Mar. 2, 2009.

U.S. Appl. No. 11/395,035, filed Mar. 31, 2006, Hahn, Response to Final Office Action Mailed Mar. 2, 2009, May 4, 2009.

U.S. Appl. No. 11/395,035, filed Mar. 31, 2006, Hahn, Non-Final Office Action Mailed Jul. 24, 2009.

U.S. Appl. No. 11/395,035, filed Mar. 31, 2006, Hahn, Response to Non-Final Office Action Mailed Jul. 24, 2009, Nov. 24, 2009.

PCT/US2007/008245, filed Mar. 30, 2007, Hahn, International Search Report, Sep. 2, 2008.

PCT/US2007/008245, filed Mar. 30, 2007, Hahn, Written Opinion, Sep. 2, 2008.

PCT/US2007/008245, filed Mar. 30, 2007, Hahn, International Preliminary Report on Patentability, Sep. 30, 2008.

U.S. Appl. No. 11/395,035, filed Mar. 31, 2006, Hahn, Final Office Action Mailed Mar. 17, 2010.

* cited by examiner

FLOORING PROFILE

FIELD OF THE INVENTION

The present invention pertains to a flooring profile. More specifically, the invention is a flooring profile for use with a hardwood or engineered hardwood flooring board.

BACKGROUND OF THE INVENTION

Hardwood flooring has become a very popular choice in floor coverings. Traditional hardwood floors are made from a variety of wood planks and are placed in side-by-side relation to each other with the side edges being engaged with a tongue and groove arrangement. In order to secure the floorboard to the subfloor, nails are driven at an angle through a portion of the tongue of the plank and into the subfloor below.

One common substitute for hardwood flooring is laminate flooring. Laminate flooring is made to look like hardwood, but is easier to install and less expensive. Laminated flooring members typically comprise a decorative surface layer, a core, a balancing backing layer, and a wear layer, which are bonded together. The decorative surface layer can be made of a resin, such as, for example a melamine/aluminum oxide based resin. The decorative surface layer is typically bonded to a moisture resistant core that can be formed from, for example, a wood composition.

Conventional cores are made of high or medium density fiberboard that is typically saturated in resins to make them extremely hard. This allows the laminate flooring members to be cut with an edge profile, such as a tongue and complementary groove, as desired, for ease of installation.

The balancing backing layer is applied to the underside of the core to help stabilize the laminate flooring member and to act as another barrier against moisture entering the laminate flooring member from below. Most manufacturers saturate the backing layer with resin to resist moisture intrusion and to make the balancing backing layer more dimensionally stable. In conventional construction, laminate flooring members formed with a balancing backing layer are not typically glued directly to the sub floor.

The wear layer is applied to provide protection and stain resistance to protect the top of the laminate flooring member. The wear layer is typically clear so that the aesthetic appearance of the decorative layer, including any color and/or printed image, is not obscured by the overlying wear layer. However, while great care is taken to ensure that the laminate flooring member looks like real hardwood flooring, any damage to the wear layer makes it evident that it is not true hardwood flooring.

Another alternative to hardwood flooring is engineered hardwood. An engineered hardwood flooring board is conventionally constructed with an upper layer, a middle layer and a lower layer. The upper layer is typically formed of conventional hardwood flooring material. The middle layer is conventionally formed of a non-hardwood material, such as medium density fiberboard, high density fiberboard, particle board, plywood and the like. The lower layer can also be formed from a hardwood material similar to the upper layer, or it can be formed from a non-hardwood material that has specially selected properties, such as water resistance or rigidity.

The upper layer of the engineered hardwood flooring board is formed of hardwood to give the board the appearance of conventional hardwood flooring and to enable the engineered hardwood flooring board to be sanded when damaged, similarly to a hardwood-only board.

Further, the use of alternative material as the middle layer, or core of the board, greatly increases the dimensional stability of the board, which allows the production of engineered hardwood flooring boards that are longer and wider than conventional hardwood flooring boards.

The material in the middle layer can be formed or milled precisely prior to assembly into the engineered hardwood flooring board, which results in boards with tight tolerances that can easily be engaged with one another to form the flooring surface. In one example, similar to conventional hardwood flooring boards, engineered hardwood flooring boards can comprise a tongue and a complementary groove positioned on and extending along opposite sides of the board. Alternatively, the boards can be secured to one another using a snap-fit profile, similar to those used in the laminate flooring industry.

Conventional method of installation may cause some installation issues when the engineered hardwood flooring boards are engaged with a traditional tongue and groove connection. Notably, due to the increased density of the core material used in the middle layer portions of the core may be displaced when a nail or other fastener is driven into the top portion of the tongue, which causes a portion of the surface of the engineered hardwood flooring board to visibly protrude or bubble. In fact, this phenomenon often occurs in conventional hardwood flooring boards. What is needed is a flooring board and a method of installing an engineered hardwood flooring board that alleviates the problem of surface bubbling.

SUMMARY

In one embodiment, the present invention pertains to a flooring panel comprising opposed pairs of substantially parallel side edges, a tongue connector member, and a groove connector member. In one aspect, the tongue connector member extends along one side edge and the groove connector member extends along the opposed side edge.

In another aspect, the tongue connector member and the groove connector member are configured to cooperatively couple with each other such that portions of the coupled flooring panels are positioned in abutting relationship. In an exemplary aspect, when respective first and second flooring panels are coupled to each other along adjacent side edges, a distal end of the upper shoulder of the tongue connector member of the first flooring panel contacts or abuts a distal end of an upper lip of the groove connector member of the second flooring panel.

Other apparatus, methods, and aspects and advantages of the invention will be discussed with reference to the Figures and to the detailed description of the preferred embodiments.

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures.

DETAILED DESCRIPTION OF THE INVENTION

Figure 1:
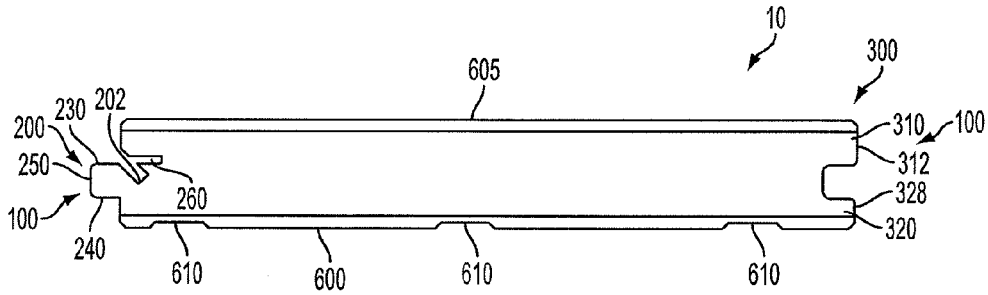
FIG. 1 is a cross-sectional view of one embodiment of a flooring panel according to the present invention showing a tongue connector with a displacement cavity and a fastening recess.
Figure 2A:
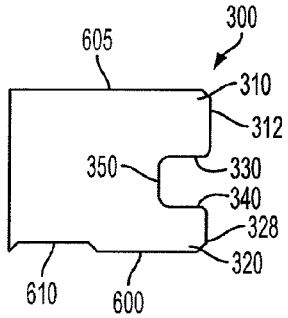
FIG. 2A is a partial cross-sectional view of the flooring panel of FIG. 1, showing a groove connector member.
Figure 2B:
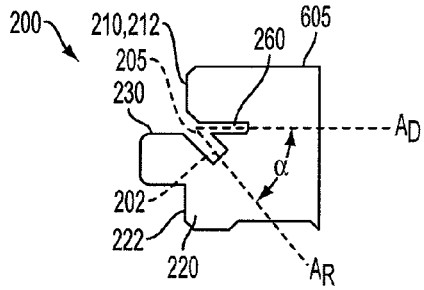
FIG. 2B is a partial cross-sectional view of the flooring panel of FIG. 1, showing the tongue connector member.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "flooring panel" includes aspects having two or more such flooring panels unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

In one aspect, the present invention is a flooring panel 10 that comprises opposed pairs of substantially parallel side edges 100. In one aspect, the flooring panel comprises a tongue and groove edge profile. In this aspect, there is a tongue connector member 200 extending along one side edge of at least one of the opposed pairs of side edges 100.

The tongue connector member 200 itself comprises an upper shoulder 210 and a lower shoulder 220 and defines a displacement cavity 260 therein. In yet another aspect, the tongue connector member has a top tongue contact surface 230, a bottom tongue contact surface 240 and a distal peripheral surface 250 that extends between the respective top and bottom tongue contact surfaces. In another aspect, a portion of the tongue connector member defines a fastening surface 202, which is configured to accept a variety of conventional fasteners, such as, for example and not meant to be limiting, one or more nails, staples, tacks, and the like. In one aspect, the fastening surface 202 is defined thereon the tongue connector member substantially beneath the displacement cavity 260. In this sense, beneath means closer to the bottom surface of the flooring panel in relation to the displacement cavity. In another aspect, the fastening surface is defined thereon the upper shoulder 210 substantially beneath the displacement cavity. In yet another aspect, the fastening surface is defined thereon a portion of a surface of the displacement cavity.

A groove connector member 300 is defined in one side edge of at least one of the opposed pairs of side edges. As illustrated in FIG. 1, the groove connector member 300 comprises an upper lip 310 and a lower lip 320. One skilled in the art would appreciate that the tongue connector member and the groove connector member are configured to cooperatively couple with each other.

In another aspect of the invention, the groove connector member 300 has an upper groove contact surface 330, a lower groove contact surface 340 and a wall surface 350 that extends between the respective top and bottom groove contact surfaces.

In another aspect, the tongue connector member 200 and the groove connector member 300 are configured to cooperatively couple with each other such that a distal end 212 of the upper shoulder 210 of a first flooring panel contacts a distal end 312 of the upper lip 310 of a second flooring panel upon coupling of the respective tongue and groove connector members of the respective first and second flooring panels to each other along adjacent side edges. In this fashion, the adjacent flooring panels have the perception of being joined when looking at the flooring system. As one skilled in the art can appreciate and as illustrated in the figures, the distal end 312 of the upper lip of the second flooring panel and the distal end 212 of the upper shoulder of the first flooring panel may be beveled such that, when the adjacent flooring panels are coupled, the seam between the two flooring panels forms a recessed channel 400. A benefit of this feature is to disguise imperfections in the flooring panels to the extent that the uppermost surfaces of the adjacent panels may not be perfectly coplanar.

Figure 3:
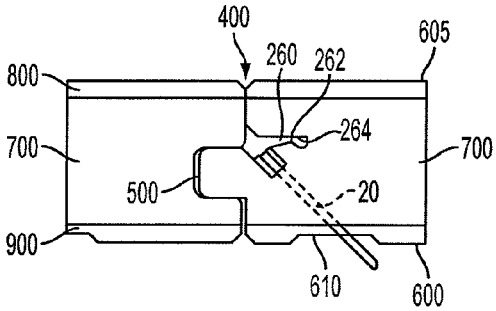
FIG. 3 is a partial cross-sectional view of two adjacent flooring panels of the embodiment of FIG. 1, showing the flooring panels in an engaged position.
Figure 4:
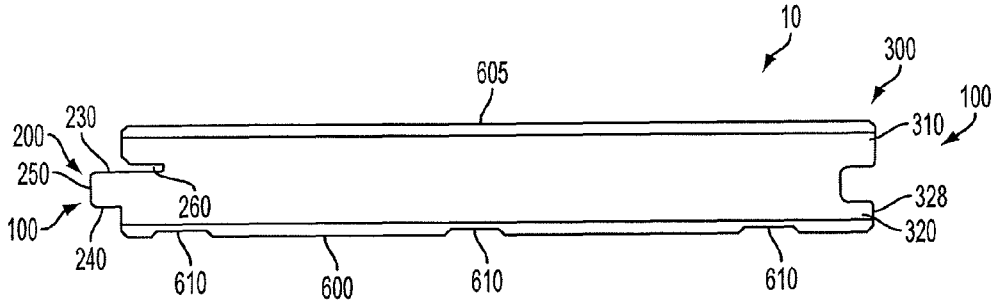
FIG. 4 is a cross-sectional view of an alternate embodiment of a flooring panel according to the present invention.
Figure 5A:
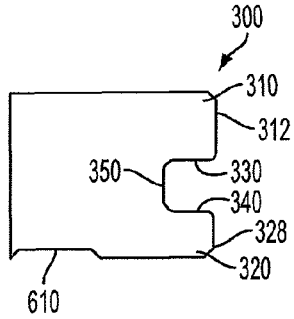
FIG. 5A is a partial cross-sectional view of the flooring panel of FIG. 4, showing a groove connector member.
Figure 5B:
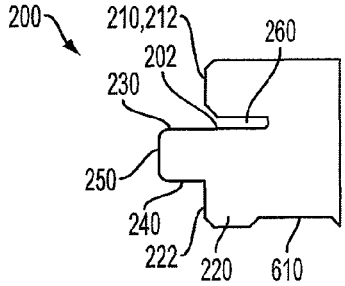
FIG. 5B is a partial cross-sectional view of the flooring panel of FIG. 4, showing the tongue connector member.
Figure 6:
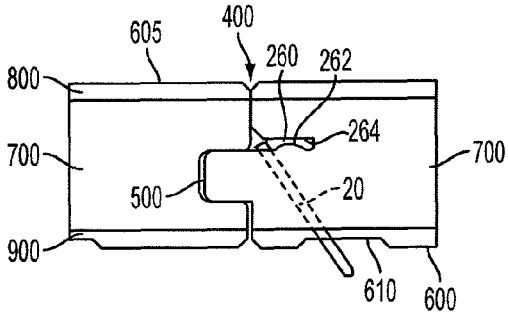
FIG. 6 is a partial cross-sectional view of two adjacent flooring panels of the embodiment of FIG. 4, showing the flooring panels in an engaged position.

The tongue connector member and the groove connector member may also be configured to cooperatively couple with each other such that a distal end 222 of the lower shoulder 220 of the first flooring panel is spaced from the distal end 328 of the lower lip 320 of the second flooring panel upon coupling of the respective tongue and groove connector members of the respective first and second flooring panels to each other along adjacent side edges 100. As illustrated in FIG. 3, this clearance helps to ensure that the visible joint on the top surface 605 of the adjoining flooring panels is substantially closed, i.e., portions of the distal ends 212, 312 of the respective adjoining upper shoulder and upper lip are placed in an abutting relationship.

In a further aspect, the tongue connector member and the groove connector member are configured to cooperatively couple with each other such that a portion of the distal peripheral surface of the tongue connector member of the first flooring panel is spaced from a portion of the wall surface 350 of the groove connector member of the second flooring panel upon coupling of the respective tongue and groove connector members of the respective first and second flooring panels to each other along adjacent side edges. The space provides additional clearance to enable the joint to completely close in the event that an obstruction, such as a splinter, or an adhesive, becomes trapped between the distal peripheral surface 250 of the tongue connector member 200 and the wall surface of the groove connector member 300. Further, in one aspect, in a coupled position, the distal peripheral surface of the tongue connector member of the first flooring panel, the wall surface of the groove connector member and portions of the respective upper and lower groove contact surfaces define a longitudinally extending pocket 500.

As mentioned herein above, the fastening surface is provided beneath the displacement cavity of the tongue connector member, such that a conventional fastener 20 may engage the flooring member with a portion of the subfloor or other installation surface. In conventional flooring profiles the placement of the fastener on a portion of the tongue connector member may cause an obstruction when the tongue connector member is attempted to be placed into operative engagement with the groove connector member, which results in the floor panels being placed in an undesirable spaced relationship. This issue is addressed in one aspect of the present invention where the fastening surface defines a recess 205 that is configured to receive a fastener. In one aspect, the recess comprises a recess axis $A_R$ that intersects the bottom surface of the flooring panel.

Where the fastening surface defines a recess, the tongue connector member may comprise one recess or a plurality of recesses. The recess may be shaped to engage an individual fastener or it may extend longitudinally substantially parallel to the upper shoulder of the tongue connector member. In yet another aspect, the recess 205 extends longitudinally substantially the length of the flooring panel. It is contemplated that the recess can be spaced along the longitudinal length of the flooring panel. Further, the recess can be spaced from the ends of the flooring panel.

As one skilled in the art can appreciate, when a fastener 20 is driven therethrough the fastening surface 202 and into the installation surface, a portion of flooring panel adjacent the fastening surface will be displaced. In conventional flooring panels, this displacement can cause material to expand and may cause the top surface 605 of the flooring panel to exhibit a visible blemish or bubble. This issue is solved by the placement of the displacement cavity 260. The displacement cavity is designed to absorb the displaced material resulting from expansion caused by the fastener 20.

In one aspect, a portion of the displacement cavity 260 forms a deformable surface 262 designed to deform and occupy a portion of the displacement cavity upon insertion of a fastener 20 into the fastening surface. In another aspect, a portion of the displacement cavity forms a non-deformable surface 264 positioned adjacent the top surface of the flooring panel. As one skilled in the art can appreciate, the non-deformable 264 surface is not designed to deform upon insertion of the fastener, thereby preventing blemishing or bubbling of the top surface of the flooring panel. In one exemplary aspect, the deformable surface is spaced from and underlies the non-deformable surface.

In another aspect, the displacement cavity comprises a displacement axis $A_D$ which forms an acute angle $\alpha$ relative to the recess axis. In yet another aspect, the displacement axis is substantially parallel to the top surface 605 of the flooring panel.

In some instances, as the fastener 20 extends therethrough the tongue connector member and exits through the bottom surface 600 of the flooring panel, it has the potential of splintering either the bottom surface of the flooring panel or the top surface of the installation surface, or both. The splinters may cause the flooring panel to lie on the installation surface in an uneven fashion. To counter this problem, in one aspect, the bottom surface of the flooring panel defines a trough 610. The trough 610 is configured to provide a relief space for the formed splinters. In another aspect, at least a portion of the trough intersects the recess axis, thereby substantially intersecting the path of the fastener. In yet another aspect, the trough extends longitudinally substantially parallel to the tongue connector member. In this aspect, the trough may or may not extend substantially the longitudinal dimension of the flooring panel.

As one skilled in the art can appreciate, the flooring panel of the present invention may comprise a hardwood material, or it may comprise a plurality of materials in a laminate structure. In one aspect, the flooring panel comprises a wood based core material 700 comprising a ground wood product and a binding agent unified to form a cured composite. As such, the core material 700 may comprise medium density fiberboard ("MDF"), high density fiberboard ("HDF"), or any other conventional wood based product. In yet another aspect, the respective tongue and groove connector members are formed from the core material.

When the flooring panel is a laminate structure, in one aspect, it comprises a decorative layer 800 connected to an upper surface of the core material. The decorative layer 800 may comprise a melamine sheet, as in conventional laminate structures. It may also comprise a hardwood material, as in engineered hardwood flooring panels. However, it may also comprise any other conventional substance used for decorative layers in laminate flooring boards.

In another aspect, the flooring panel comprises a bottom support layer 900 connected to a lower surface of the core material. If the flooring panel comprises a trough 610 defined in its bottom surface, the trough may be defined therein bottom surface of the bottom support layer 900.

In still a further aspect, the invention is a method for making the flooring panel described herein. The method comprises the steps of: providing at least one plank of flooring material; forming the aforementioned tongue connector member into and extending along at least one of the side edges of the pair of opposed side edges to include forming the displacement cavity; and forming the aforementioned groove connector member into and extending along a side edge opposite of the tongue.

In another aspect, the method comprises forming the aforementioned recess in the fastening surface. As mentioned herein above, the recess may comprise a plurality of recesses. Additionally, the method may also comprise forming the trough in the bottom surface of the flooring panel.

In yet another aspect, with respect to forming a flooring panel comprising a core material, the method may also comprise connecting a decorative layer to an upper surface of the core material. The method may also comprise connecting a bottom support layer to a lower surface of the core material. As one skilled in the art can appreciate these additional steps may be executed in any conventional manner.

In one aspect, the invention is a method of assembling a floor using a plurality of the flooring panels described herein. The method comprises the steps of:

a) providing a plurality of planks of the aforementioned flooring panels;

b) placing a first one of the planks on an installation surface or subfloor, which substantially underlies the bottom surface of the plank;

c) driving at least one fastener through the fastening surface of the tongue connector member such that a portion of the fastener penetrates into the installation surface, and such that a portion of the deformable surface of the displacement cavity deforms into the displacement cavity;

d) placing a second plank on the installation surface such that the groove connector member of the second plank cooperatively engages the tongue connector member of the first plank; and e) repeating steps (c) and (d) for additional planks until the total number of desired planks is achieved.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

We claim:

1. A flooring panel, comprising:

opposed pairs of substantially parallel side edges;

a tongue connector member extending along one side edge of at least one of the opposed pairs of side edges, the tongue connector member comprising:

a top tongue contact surface;

an upper shoulder and a lower shoulder;

means for preventing blemishing of a top surface of the flooring panel comprising a displacement cavity defined at least partially by the top tongue contact surface and having a displacement axis;

means for guiding a fastener comprising an elongate recess defined and extending inwardly therein a portion of the top tongue contact surface and underlying the displacement cavity, wherein, in cross-section of the tongue connector member, the elongate recess has an elongate length dimension that has a centerline recess axis positioned at an acute angle relative to the displacement axis, wherein a portion of the top tongue contact surface defining the displacement cavity defines a displaceable surface; and a groove connector member defined in one side edge of at least one of the opposed pairs of side edges, the groove connector member comprising an upper lip and a lower lip, wherein the tongue connector member and the groove connector member are configured to cooperatively couple with each other such that a distal end of the upper shoulder of a first flooring panel contacts a distal end of the upper lip of a second flooring panel upon coupling of the respective tongue and groove connector members of the respective first and second flooring panels to each other along adjacent side edges.

2. The flooring panel of claim 1, wherein a portion of the displacement cavity forms a top cavity surface which is positioned substantially parallel to and adjacent the top surface.

3. The flooring panel of claim 2, wherein the displaceable surface is movable between a first position and a second position in which at least a portion of the displaceable surface is displaced toward the displacement axis, and wherein, in the first position, at least a portion of the displaceable surface is spaced from and underlies the top cavity surface at a first distance.

4. The flooring panel of claim 3, wherein, in the second position, at least a portion of the displaceable surface is spaced from and underlies the top cavity surface at a second distance, and wherein the second distance is less than the first distance.

5. The flooring panel of claim 4, wherein a portion of the elongate recess defines a fastening surface.

6. The flooring panel of claim 4, wherein the displacement cavity extends longitudinally substantially parallel to the upper shoulder of the tongue connector member.

7. The flooring panel of claim 4, wherein the flooring panel has a longitudinal length, and wherein the elongate recess extends longitudinally substantially the longitudinal length of the flooring panel.

8. The flooring panel of claim 4, wherein the centerline recess axis intersects a bottom surface of the flooring panel.

9. The flooring panel of claim 8, wherein the bottom surface defines a trough.

10. The flooring panel of claim 9, wherein at least a portion of the trough intersects the centerline recess axis.

11. The flooring panel of claim 9, wherein the trough extends longitudinally substantially parallel to the tongue connector member.

12. The flooring panel of claim 11, wherein the trough extends substantially the longitudinal dimension of the flooring panel.

13. The flooring panel of claim 4, wherein the flooring panel comprises a wood based core material comprising a ground wood product and a binding agent unified to form a cured composite.

14. The flooring panel of claim 13, wherein the core material comprises MDF.

15. The flooring panel of claim 13, wherein the core material comprises HDF.

16. The flooring panel of claim 13, wherein the flooring panel comprises a decorative layer connected to an upper surface of the core material.

17. The flooring panel of claim 16, wherein the decorative layer is formed from a hardwood.

18. The flooring panel of claim 13, wherein the flooring panel comprises a bottom support layer connected to a lower surface of the core material.

19. The flooring panel of claim 18, wherein the bottom support layer has a bottom surface, and wherein the bottom surface defines a trough.

20. The flooring panel of claim 19, wherein the trough extends longitudinally substantially parallel to the tongue connector member.

21. The flooring panel of claim 19, wherein the trough extends substantially the longitudinal dimension of the flooring panel.

22. The flooring panel of claim 18, wherein the bottom support layer is formed from a hardwood.

23. The flooring panel of claim 13, wherein the respective tongue and groove connector members are made from the core material.

24. The flooring panel of claim 1, wherein the tongue connector member and the groove connector member are configured to cooperatively couple with each other such that a distal end of the lower shoulder of the first flooring panel is spaced from a distal end portion of the lower lip of the second flooring panel upon coupling of the respective tongue and groove connector members of the respective first and second flooring panels to each other along adjacent side edges.

25. The flooring panel of claim 1, wherein the tongue connector member comprises a bottom tongue contact surface and distal peripheral surface that extends between the respective top and bottom tongue contact surfaces.

26. The flooring panel of claim 25, wherein the groove connector member has an upper groove contact surface, a lower groove contact surface and a wall surface extending between the respective top and bottom groove contact surfaces.

27. The flooring panel of claim 26, wherein the tongue connector member and the groove connector member are configured to cooperatively couple with each other such that a portion of the distal peripheral surface of the tongue connector member of the first flooring panel is spaced from a portion of the wall surface of the groove connector member of the second flooring panel upon coupling of the respective tongue and groove connector members of the respective first and second flooring panels to each other along adjacent side edges.

28. The flooring panel of claim 26, wherein, in a coupled position, the distal peripheral surface of the tongue connector member of the first flooring panel, the wall surface of the groove connector member and portions of the respective upper and lower groove contact surfaces define a longitudinally extending pocket.

29. The flooring panel of claim 1, wherein the displacement axis is substantially parallel to the top surface of the flooring panel.

30. The flooring panel of claim 1, wherein the elongate recess completely underlies the upper shoulder of the tongue connector member.

31. The flooring panel of claim 1, wherein the centerline recess axis is normal to a longitudinal axis of the flooring panel.

32. The flooring panel of claim 1, wherein the fastening surface is a planar fastening surface.

33. A method for making a flooring panel, comprising:

providing at least one plank of flooring material, each plank comprising a pair of opposed side edges, a top surface and a bottom surface;

forming a tongue connector member into and extending along at least one of the side edges of the pair of opposed side edges that is configured for preventing blemishing of a top surface of the flooring panel, the tongue connector member comprising:

an upper shoulder and a lower shoulder;

a top tongue contact surface;

a bottom tongue contact surface;

a distal peripheral surface extending between the respective top and bottom tongue contact surfaces;

a displacement cavity defined at least partially by the top tongue contact surface and having a displacement axis; and an elongate recess defined and extending inwardly therein a portion of the top tongue contact surface and underlying the displacement cavity, wherein, in cross-section of the tongue connector member, the elongate recess has an elongate length dimension that has a centerline recess axis positioned at an acute angle relative to the displacement axis, and wherein a portion of the top tongue contact surface defining the displacement cavity defines a displaceable surface; and forming a groove connector member into and extending along a side edge opposite of the tongue, the groove connector member comprising an upper lip and a lower lip, wherein the groove connector member has an upper groove contact surface, a lower groove contact surface, and a wall surface extending between the respective upper and lower groove contact surfaces; wherein the tongue connector member and the groove connector member are configured to cooperatively couple with each other such that a distal end of the upper shoulder of a first flooring panel contacts a distal end of the upper lip of a second flooring panel upon coupling of the respective tongue and groove connector members of the respective first and second flooring panels to each other along adjacent side edges.

34. The method of claim 33, wherein the displaceable surface is movable between a first position and second position, in which at least a portion of the displaceable surface is displaced into the displacement cavity and toward the displacement axis.

35. The method of claim 34, wherein a portion of the displacement cavity forms a top cavity surface which is positioned substantially parallel to and adjacent the top surface, and wherein, in the first position, at least a portion of the displaceable surface is spaced from and underlies the top cavity surface at a first distance.

36. The method of claim 35, wherein in the second position, at least a portion of the displaceable surface is spaced from and underlies the top cavity surface at a second distance, and wherein the second distance is less than the first distance.

37. The method of claim 33, wherein the displacement axis forms an acute angle relative to the centerline recess axis.

38. The method of claim 37, wherein the displacement axis is substantially parallel to the top surface of the flooring panel.

39. The method of claim 33, further comprising forming at least a portion of the tongue connector member and groove connector member from a wood based core material comprising a ground wood product and a binding agent unified to form a cured composite.

40. The method of claim 39, wherein the core material comprises MDF.

41. The method of claim 39, wherein the core material comprises HDF.

42. The method of claim 39, further comprising connecting a decorative layer to an upper surface of the core material.

43. The method of claim 42, wherein the decorative material comprises a hardwood.

44. The method of claim 39, further comprising connecting a bottom support layer to a lower surface of the core material.

45. The method of claim 44, further comprising forming a trough in a bottom surface of the bottom support layer.

46. The method of claim 45, wherein at least a portion of the trough intersects the centerline recess axis.

47. The method of claim 33, wherein the elongate recess completely underlies the upper shoulder of the tongue connector member.

48. The method of claim 33, wherein a portion of the elongate recess defines a planar fastening surface.

49. A method of assembling a floor, comprising:

a. providing a plurality of planks of flooring material, each plank comprising:

i. opposed pairs of substantially parallel side edges, a top surface, and a bottom surface;

ii. a tongue connector member extending along at least one of the side edges of the pair of opposed side edges, the tongue connector member comprising:

an upper shoulder;

a lower shoulder;

a top tongue contact surface;

a bottom tongue contact surface;

a displacement cavity defined at least partially by the top tongue contact surface and having a displacement axis; and an elongate recess defined and extending inwardly therein a portion of the top tongue contact surface and underlying the displacement cavity, wherein, in cross-section of the tongue connector member, the elongate recess has an elongate length dimension that has a centerline recess axis positioned at an acute angle relative to the displacement axis, wherein a portion of the top tongue contact surface defining the displacement cavity defines a displaceable surface, and wherein the displaceable surface is movable between a first position and a second position in which at least a portion of the displaceable surface is displaced into the displacement cavity and toward the displacement axis; and iii. a groove connector member defined in one side edge of at least one of the opposed pairs of side edges, the groove connector member comprising an upper lip and a lower lip, wherein the tongue connector member and the groove connector member are configured to cooperatively couple with each other such that a distal end of the upper shoulder of a first flooring panel contacts a distal end of the upper lip of a second flooring panel upon coupling of the respective tongue and groove connector members of the respective first and second flooring panels to each other along adjacent side edges;

b. placing a first one of the plurality of planks on an installation surface, whereby the installation surface substantially underlies the bottom surface of the plank;

c. driving at least one fastener therethrough a fastening surface of the elongate recess such that a portion of the fastener penetrates into the installation surface and such that a portion of the displaceable surface is displaced to the second position and is contained within the displacement cavity to prevent blemishing of the top surface of the flooring panel;

d. placing a second one of the plurality of planks on the installation surface such that the groove connector member of the second plank cooperatively engages the tongue connector member of the first plank; and e. repeating steps (c) and (d) for additional planks until a total number of desired planks is achieved.

50. The method of claim 49, wherein the displacement axis is substantially parallel to the top surface of the flooring panel.

* * * * *